US011319768B1

(12) United States Patent
Baugh

(10) Patent No.: US 11,319,768 B1
(45) Date of Patent: May 3, 2022

(54) METHOD FOR LIGHTWEIGHT SUBSEA BLOWOUT PREVENTER UMBILICALS

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 17/386,780

(22) Filed: Jul. 28, 2021

(51) Int. Cl.
*E21B 33/038* (2006.01)
*E21B 17/01* (2006.01)
*E21B 33/064* (2006.01)

(52) U.S. Cl.
CPC ..... *E21B 33/0385* (2013.01); *E21B 17/01* (2013.01); *E21B 33/064* (2013.01)

(58) Field of Classification Search
CPC ..... E21B 33/038; E21B 33/064; E21B 17/01
See application file for complete search history.

(56) References Cited

U.S. PATENT DOCUMENTS 3,460,614 A * 8/1969 Burgess ..... E21B 33/0355 166/335
3,701,549 A * 10/1972 Koomey ..... F16L 37/56 285/24
3,820,600 A * 6/1974 Baugh ..... E21B 33/038 166/338
3,957,079 A * 5/1976 Whiteman ..... E21B 33/0355 137/596.18
4,284,143 A * 8/1981 Scherrer ..... E21B 17/01 166/350
4,401,164 A * 8/1983 Baugh ..... E21B 17/01 166/339
4,453,566 A * 6/1984 Henderson, Jr. ..... F16L 39/02 137/236.1
4,648,629 A * 3/1987 Baugh ..... E21B 33/038 285/26
8,550,169 B2 * 10/2013 McKay ..... E21B 33/038 166/343
2010/0155073 A1 * 6/2010 Blank ..... E21B 34/16 166/338

FOREIGN PATENT DOCUMENTS

GB 2551788 A * 1/2018 ..... F16L 1/24

OTHER PUBLICATIONS

I filed a provisional application Jun. 29, 2020 as EFS ID 40134555 and U.S. Appl. No. 63/057,965 and intended to link this application to it, but could not figure out how to do it.

* cited by examiner

*Primary Examiner* — Aaron L Lembo

(57) ABSTRACT

In a subsea blowout preventer stack system connected to the surface with a drilling riser and with one or more control pods for control of the subsea blowout preventer stack, a method of providing a control umbilical of near neutral weight in the ocean water to provide control signals to the one or more control pods comprising providing a core of conductors such as wires and optical fibers, providing a flexible outer core comprising a mixture of resilient material and buoyant materials, providing a connector on the lower end of the umbilical.

19 Claims, 6 Drawing Sheets

METHOD FOR LIGHTWEIGHT SUBSEA BLOWOUT PREVENTER UMBILICALS

TECHNICAL FIELD

This invention relates to the method of providing a light weight or neutrally buoyant umbilicals for subsea blowout preventer stacks.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater offshore drilling requires that a vessel at the surface be connected through a drilling riser and a large blowout preventer stack to the seafloor wellhead. The seafloor wellhead is the structural anchor piece into the seabed and the basic support for the casing strings which are placed in the well bore as long tubular pressure vessels. During the process of drilling the well, the blowout preventer stack on the top of the subsea wellhead provides the second level of pressure control for the well. The first level being provided by the weighted drilling mud within the bore.

During the drilling process, weighted drilling mud circulates down a string of drill pipe to the drilling bit at the bottom of the hole and back up the annular area between the outside diameter of the drill pipe and the inside diameter of the drilled hole or the casing, depending on the depth.

Coming back up above the blowout preventer stack, the drilling mud will continue to travel back outside the drill pipe and inside the drilling riser, which is much large than the casing. The drilling riser has to be large enough to pass the casing strings run into the well, as well as the casing hangers which will suspend the casing strings. The bore in a contemporary riser will be at least twenty inches in diameter. It additionally has to be pressure competent to handle the pressure of the weighed mud, but does not have the same pressure requirement as the blowout preventer stack itself.

As wells are drilled into progressively deeper and deeper formations, the subsurface pressure and therefore the pressure which the blowout preventer stack must be able to withstand becomes greater and greater. This is the same for drilling on the surface of the land and subsea drilling on the surface of the seafloor. Early subsea blowout preventer stacks were of a 5,000 p.s.i. working pressure, and over time these evolved to 10,000 and 15,000 p.s.i. working pressure. As the working pressure of components becomes higher, the pressure holding components naturally become both heavier and taller. Additionally, in the higher pressure situations, redundant components have been added, again adding to the height. The 15,000 blowout preventer stacks have become in the range of 800,000 lbs. and 80 feet tall. This provides enormous complications on the ability to handle the equipment as well as the loadings on the seafloor wellhead. In addition to the direct weight load on the subsea wellheads, side angle loadings from the drilling riser when the surface vessel drifts off the well centerline are an enormous addition to the stresses on both the subsea wellhead and the seafloor formations.

Another complication is that with all the weight and size of the blowout preventer stacks, duplicate heavy umbilicals are required to provide operational control signals to the blowout preventer stacks via duplicate control pods. Especially in deeper water of several thousand feet, the umbilicals are so heavy that they cannot simply be suspended in the water as with weights of 10,000-15,000 lbs. heavy and high capacity winches would be required to handle them. Additionally, during the drilling process in deep water the vessels are characteristically floating vessels which continuously heave with the ocean waves causing a continual dynamic motion on the supporting winch. For these reasons, the heavy umbilicals are clamped to the drilling riser every two or three joints for support.

As the control pods are one of the historical components needing service and maintenance, it is difficult to retrieve a control pod with a very heavy umbilical attached. Typically, the drilling riser and lower marine riser package portion of the blowout preventer stack must be brought to the surface for control pod or umbilical maintenance. This is how the umbilicals have been made for the past 60 years of offshore drilling, and continues to be a problem.

BRIEF SUMMARY OF THE INVENTION

The object of this invention is provide an umbilical for subsea drilling systems which is neutrally buoyant.

A second object of this invention is to allow the recovery of a subsea blowout preventer stack control pod without having to recover the lower marine riser package and without handling a heavy umbilical.

A third object of this invention is provide a connector for the lower end of the neutrally buoyant umbilical connector.

Another object of this invention is to interface the connector with an acoustic control pod on the lower blowout preventer stack.

BRIEF DESCRIPTION OF THE DRAWINGS

FIG. 3 is a perspective view of a subsea wellhead housing which the blowout preventer stack of this invention would land on.

DETAILED DESCRIPTION OF THE INVENTION

Figure 1:
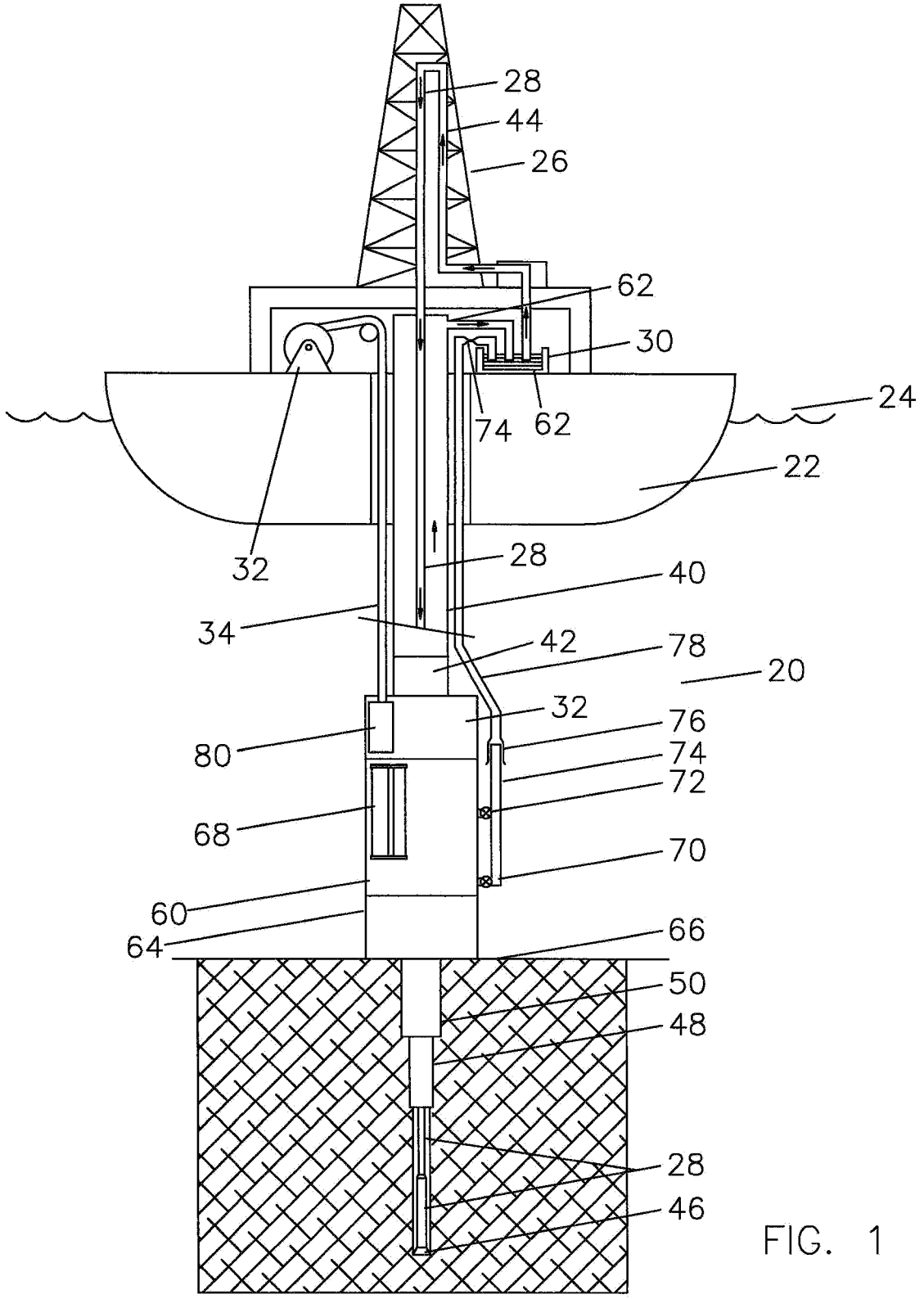
FIG. 1 is a view of a contemporary deep-water riser system.

Referring now to FIG. 1, a view of a system 20 which might use the present invention is shown. It shows a floating vessel 22 on a body of water 24 and having a derrick 26. Drill pipe 28, drilling mud system 30, control reel 32, and control cable 34 are shown. A riser system 40 including a flex joint 42 is shown. During drilling the drilling mud circulated from the drilling mud system 30, up the standpipe 44, down the drill pipe 28, through the drill bit 46, back up through the casing strings 48 and 50, through the blowout preventer stack 60, up thru the riser system 40, and out the bell nipple at 62 back into the mud system 30.

Blowout preventer stack 60 is landed on a subsea wellhead system 64 landed on the seafloor 66. The blowout preventer stack 60 includes pressurized accumulators 68, kill valves 70, choke valves 72, choke and kill lines 74, choke and kill connectors 76, choke and kill flex means 78, and control pods 80.

Figure 2:
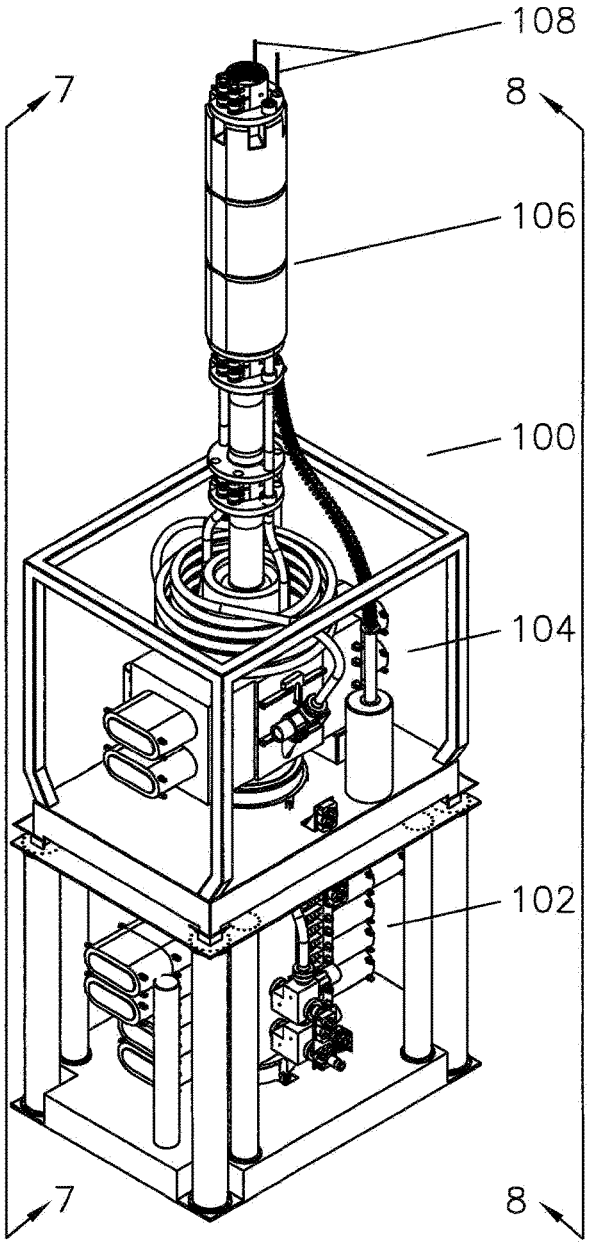
FIG. 2 is a perspective view of a blowout preventer stack utilizing the features of this invention.

Referring now to FIG. 2, the seafloor drilling system 100 comprises a lower blowout preventer stack 102, a lower marine riser package 104, a drilling riser joint 106, and control cables 108.

Figure 3:
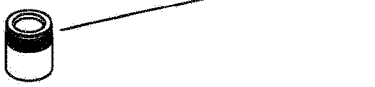

Referring now to FIG. 3, a subsea wellhead is shown which the seafloor drilling system lands on. It is the unseen upper portion of the subsea wellhead system 64 shown in FIG. 1.

Figure 4:
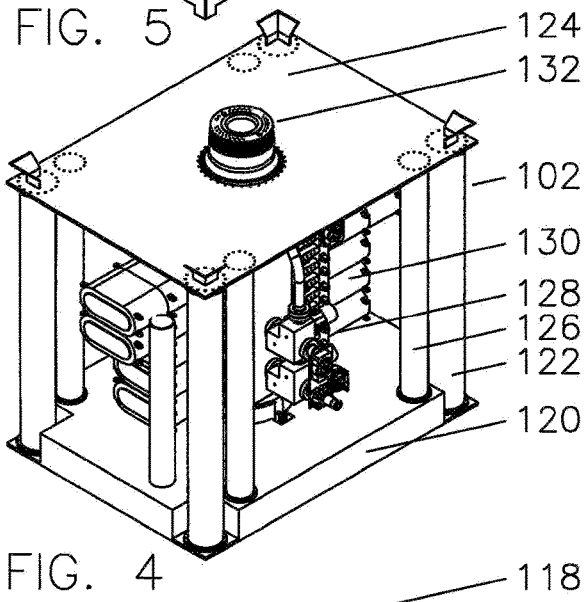
FIG. 4 is a perspective view of the lower portion of the blowout preventer stack of FIG. 2, generally called the lower BOP stack.

Referring now to FIG. 4, the lower blowout preventer stack 102 comprises a lower structural section 120, vertical support bottle 122, and upper structural section 124, accumulators 126, choke and kill valves 128, blowout preventers 130 and an upper mandrel 132 which will be the connection point for the lower marine riser package.

Figure 5:
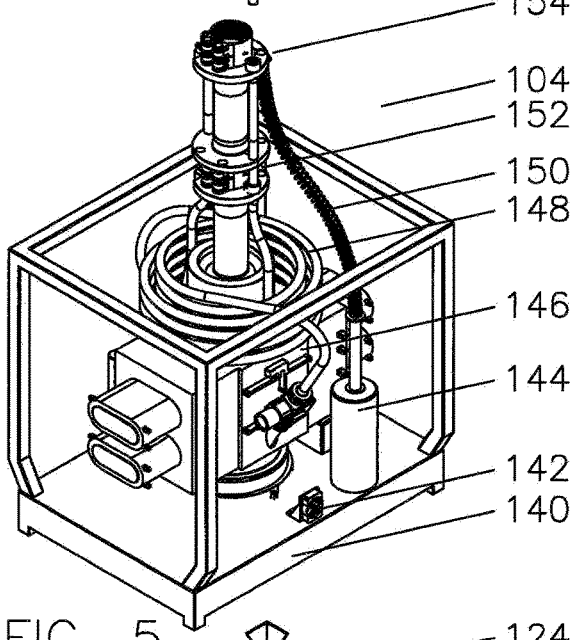
FIG. 5 is a perspective view of the upper portion of the blowout preventer stack of FIG. 2, generally called the lower marine riser package or LMRP.

Referring now to FIG. 5 the lower marine riser package 104 is shown comprising a lower marine riser package structure 140, an interface 142 for a remotely controlled vehicle (ROV), annular blowout preventers 146, choke and kill flex loops 148, a flexible passageway 150, a riser connector 152, and an upper half of a riser connector 154.

Figure 6:
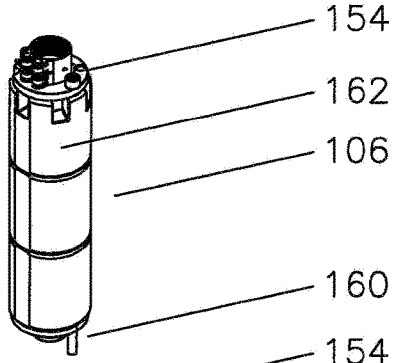
FIG. 6 is a perspective view of a section of the drilling riser which will be used to lower the blowout preventer stack.

Referring now to FIG. 6, a drilling riser joint 106 is shown having a lower half of a riser connector 160, a upper half of a riser connector 154, and buoyancy sections 162.

Figure 7:
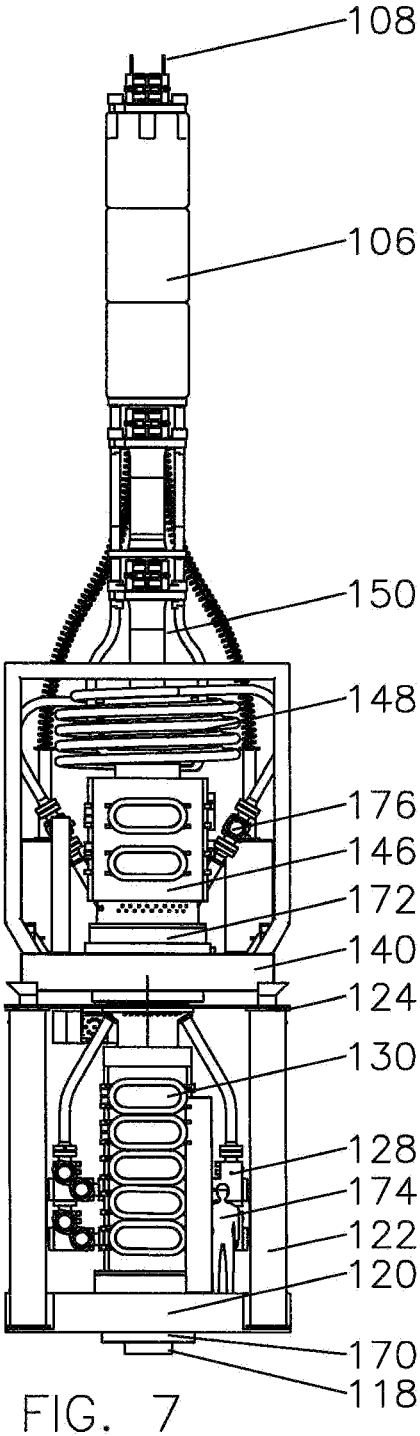
FIG. 7 is a view of the blowout preventer stack of FIG. 2, taken along lines "7-7".

Referring now to FIG. 7, is a view of seafloor drilling system 100 taken along lines "7-7" of FIG. 1 showing wellhead connector 170, lower marine riser connector 172, a man 174 for size perspective, and choke and kill valves 176.

Figure 8:
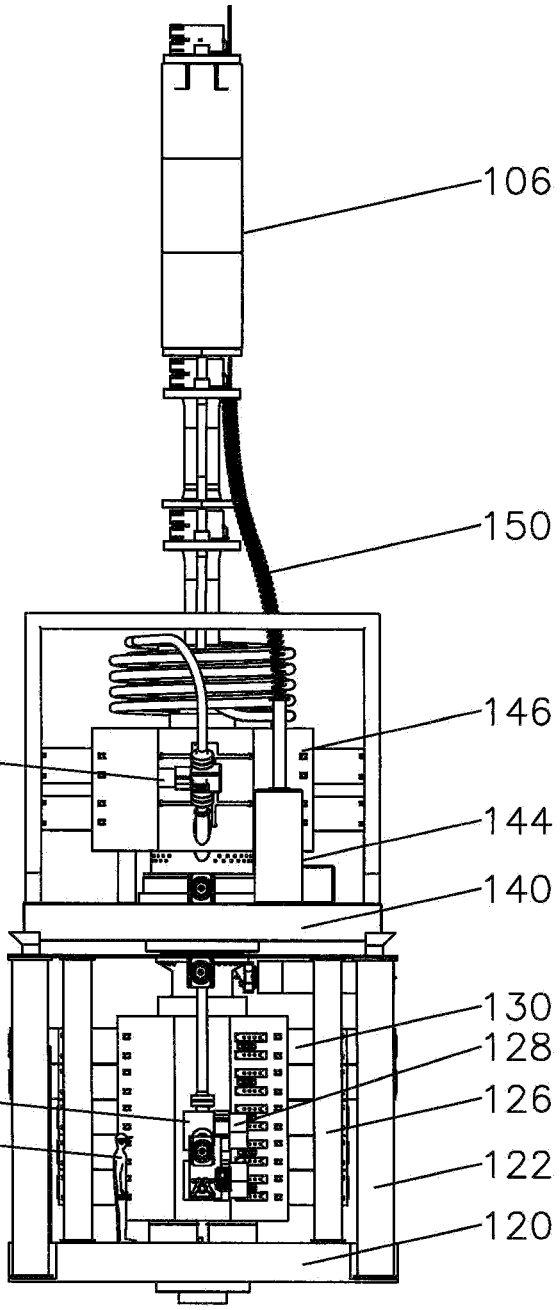
FIG. 8 is a view of the blowout preventer stack of FIG. 2, taken along lines "8-8".

Referring now to FIG. 8, is a view of seafloor drilling system 100 taken along lines "8-8" of FIG. 1.

Figure 9:
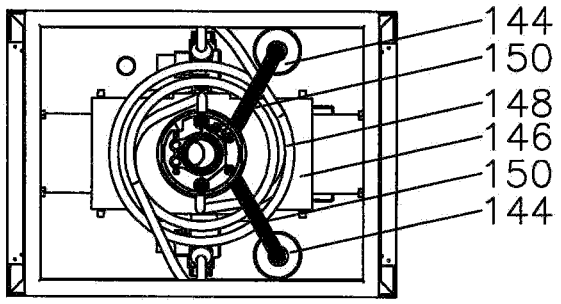
FIG. 9 is a top view of FIG. 8.

Referring now to FIG. 9, is a top view of seafloor drilling system 100.

Figure 10:
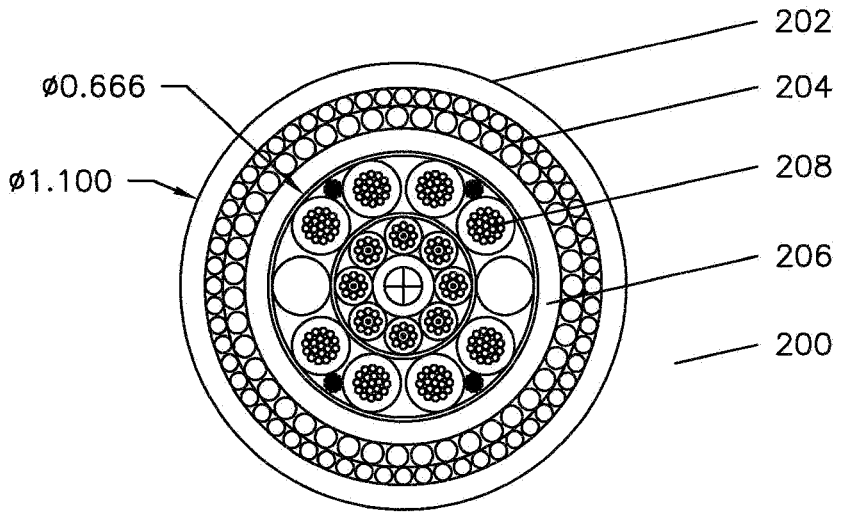
FIG. 10 PRIOR ART
FIG. 10 is a cross section view of a prior art umbilical for a subsea blowout preventer stack.

Referring now to FIG. 10 a typical prior art control cable for the blue and yellow control pods on a subsea blowout preventer stack is about 1.1" in diameter and weighs about 1.22 lb./ft. in air and about 0.8 lb./ft. in seawater. This means that when deploying 12,000 feet of cable from the reel on the floating drill ship, the in-water weight will be about 9,600 lbs. The typical reel on the deck of the surface vessel will have a minimum lifting capacity of 1000 lbs., so the weight of the cable is conventionally carried by clamping it in numerous places to the drilling riser. Conventional control cable 200 is shown to have and outer layer polyethylene jacket 202, layers of steel strength members 204, a second polyethylene jacket 206, and a core 208 of electrical, fiber optic, and filler wires.

Figure 11:
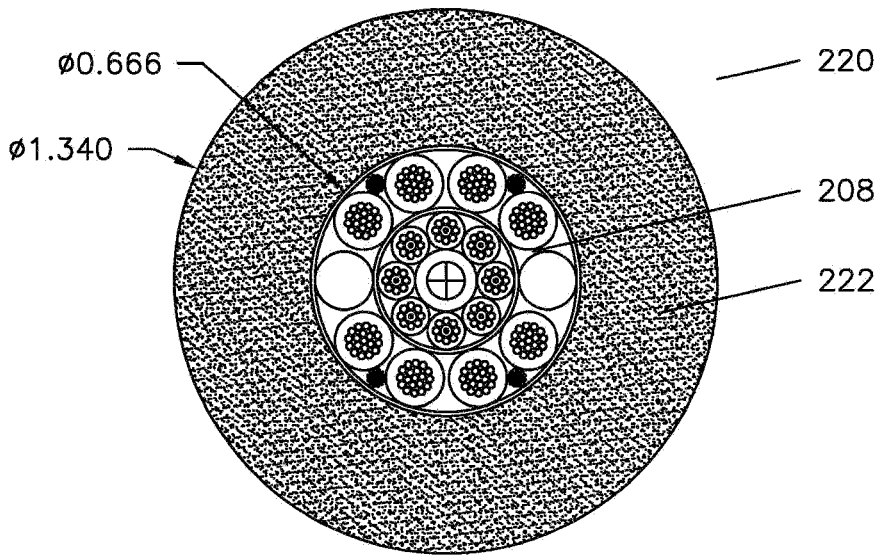
FIG. 11 is a cross section view of a neutrally buoyant umbilical for a subsea blowout preventer stack.

Referring now to FIG. 11, neutrally buoyant cable 220 is shown to have a similar core 208 of electrical, fiber optic, and filler wires and an outer layer 222 of a resilient material such as polyethylene and buoyancy beads. The buoyancy beads are a material such as glass micro-spheres. The unit weight of the polyethylene will be similar to the weight of the material making up the riser buoyancy joints before the flotation beads are added to them. Enough buoyancy beads will be mixed into the polyethylene to make the net weight of the neutrally buoyant cable 220 be neutrally buoyant in seawater, still leaving enough polyethylene in place for the cable to be flexible. This means that the deployment of 12,000 feet of this cable will yield a net weight of zero in seawater. That allows the cable to be run independently of the riser, all that is needed now is a guide and a weight on the lower end.

Figure 12:
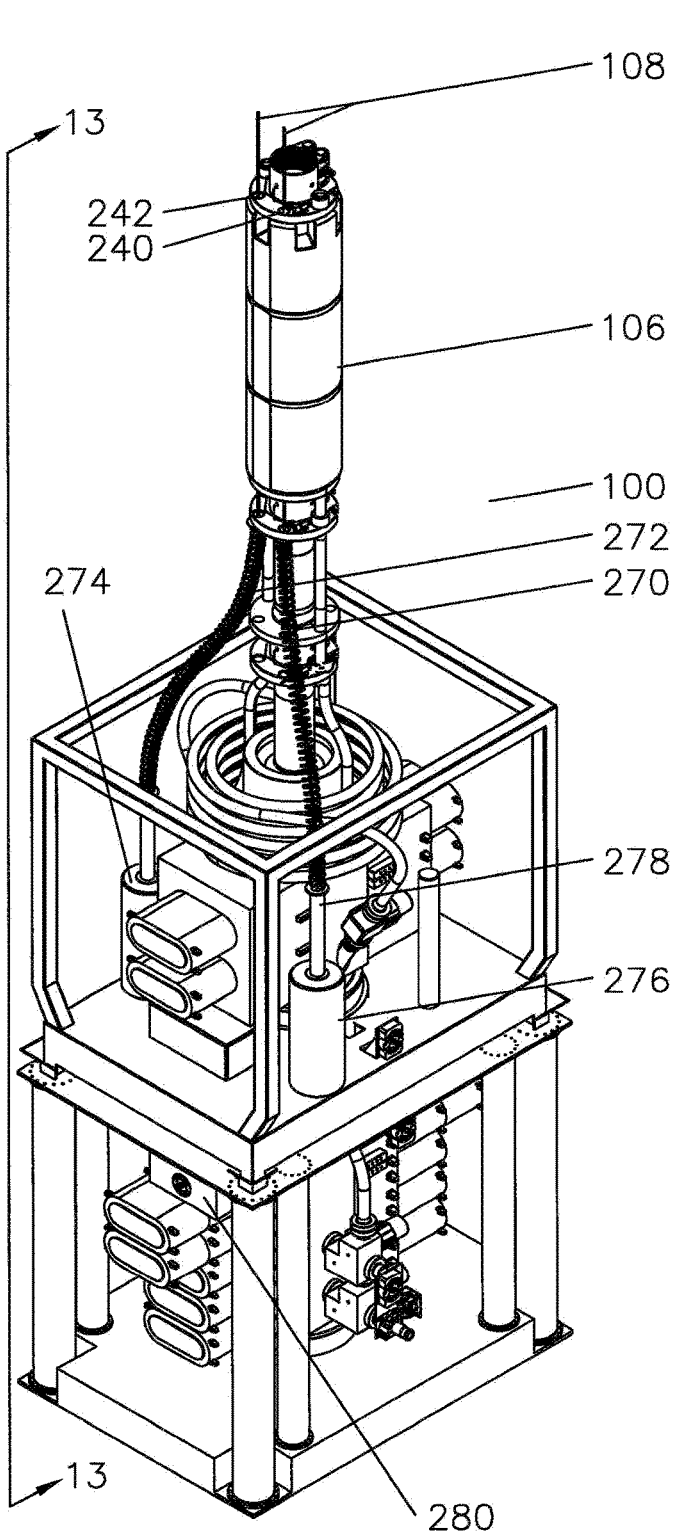
FIG. 12 is a perspective view of seafloor drilling system 100 similar to FIG. 2 except rotated 180°

Referring now to FIG. 12 is a perspective view of seafloor drilling system 100 similar to FIG. 2 except rotated 180°, drilling riser joint 106 having blue pod conduit 240 and yellow pod conduit 242, control cables 108 passing through blue pod conduit 240 and yellow pod conduit 242, blue flexible conduit 270, yellow flexible conduit 272, yellow control pod 274, blue control pod 276, blue spacer 278, and acoustic control pod 280.

Figure 13:
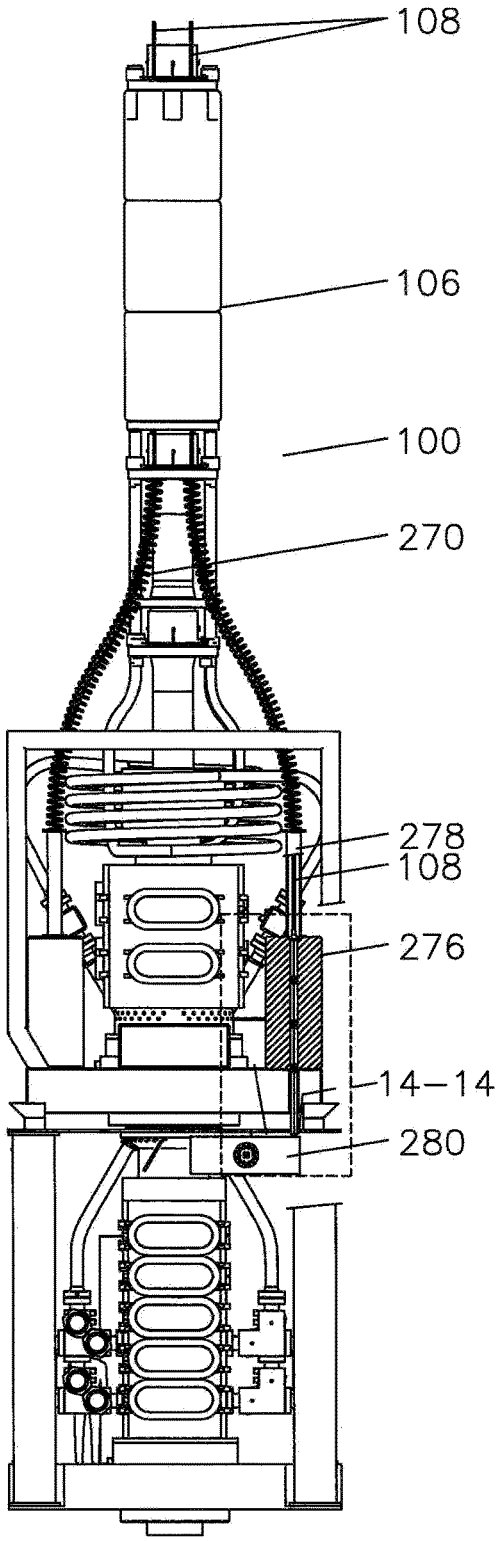
FIG. 13 is an end view of the subsea blowout preventer stack of FIG. 12 taken along lines "13-13".

Referring now to FIG. 13 which is taken along lines "13-13" of FIG. 12 showing a portion sectioned at "14-14".

Figure 14:
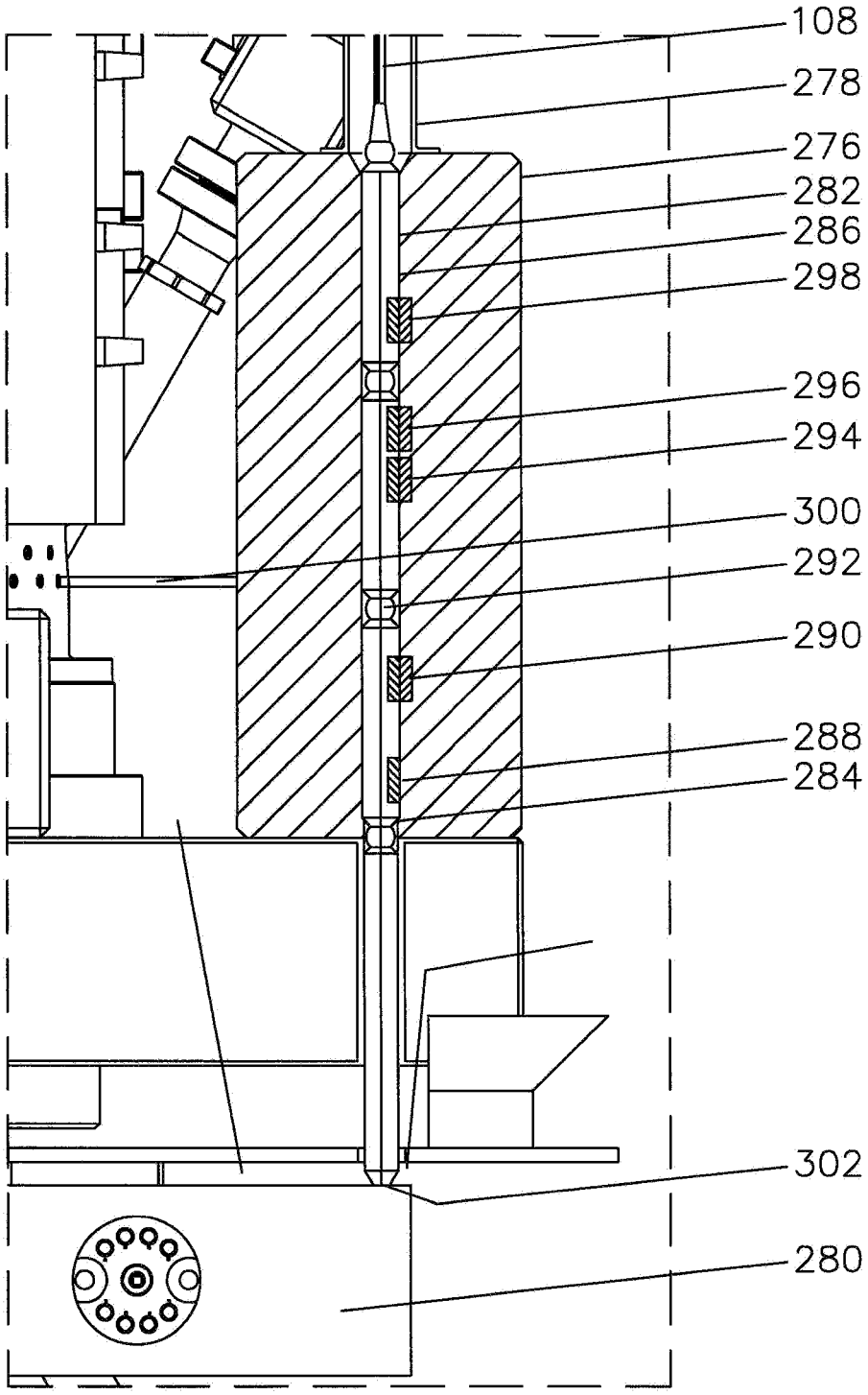
FIG. 14 is a partial view of FIG. taken from the box "14-14" showing an expanded view of the neutrally buoyant cable connector.

Referring now to FIG. 14 which is taken from the box "14-14" of FIG. 13 which shows a half section of blue control pod 276 having a central bore 282, a landing shoulder 284, control cable termination 286 landed on landing shoulder 284, orientation interface 288 such as wheels or cams, electrical interface 290, flex joint 292, hydraulic interface 294, fiber optic interface 296, and mechanical interface 298. Also shown are hydraulic control line 300, and interface 302 with acoustic control pod 280. The mechanical interface 298 can be used for functions such as to actuate a hydraulic valve within the blue control pod 276. The interface 302 can be used for functions such as to keep the acoustic control pod 280 charged and keep it ready for operation. The acoustic control pod 280 can be utilized to actuate the wellhead connector 170 when the subsea drilling system 100 is first landed and the control cables 108 and control cable termination 286 are being run. This system allows the electronics within the control cable termination to be retrieved independently of having to pull the entire drilling riser and lower marine riser package.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. In a subsea blowout preventer stack system connected to the surface with a drilling riser comprising a central tube and buoyant material surrounding the central tube, and with one or more control pods for control of the subsea blowout preventer stack, a method of providing a control umbilical of near neutral weight in the ocean water to provide control signals to the one or more control pods comprising providing a core of conductors such as wires and optical fibers, providing a flexible outer core comprising a mixture of resilient material and buoyant materials, providing a connector on the lower end of the umbilical, and lowering the connector and the control umbilical down passages within the buoyant material on the drilling riser.

2. The method of claim 1 further providing that the resilient material is polyethylene.

3. The method of claim 1 further providing the buoyant material is glass beads.

4. The method of claim 1 further providing the connector has wheels to engage a receptacle to orient the connector.

5. The method of claim 1 further providing the connector has wheels to engage a receptacle to fully axially engage the connector with the receptacle.

6. The method of claim 1 further providing the connector has a latch to lock the connector into a receptacle.

7. The method of claim 6 further providing the receptacle is in the control pod.

8. The method of claim 1 further providing that the connector extends to contact an acoustic control pod to recharge the acoustic control pod and/or communicate with the acoustic control pod.

9. The method of claim 8 further providing the acoustic control pod is on the lower blowout preventer stack.

10. The method of claim 1 further providing a flexible conduit to transition from the lower end of a passage within buoyant material surrounding the central tube of the drilling riser to a receptacle in one of the one or more control pods.

11. The method of claim 10 further providing the flexible conduit comprises a spring like coil of metal.

12. In a subsea blowout preventer stack system connected to the surface with a drilling riser comprising a central tube and buoyant material surrounding the central tube, and with one or more control pods for control of the subsea blowout preventer stack, a method of providing a control umbilical of near neutral buoyancy in the ocean water to provide control signals to the one or more control pods comprising providing a core of conductors such as wires and optical fibers, providing a flexible outer core comprising a mixture of resilient material and buoyant materials, providing a connector on the lower end of the umbilical, and lowering the connector and the control umbilical down passages within the buoyant material on the drilling riser.

13. The method of claim 12 further providing that the connector extends to contact a control pod on the lower blowout preventer stack to recharge the control pod on the lower blowout preventer stack and/or communicate with the control pod on the lower blowout preventer stack.

14. The method of claim 13 further providing the control pod on the lower blowout preventer stack is an acoustic control pod.

15. The method of claim 12 further providing a flexible conduit to transition from the lower end of a passage within buoyant material surrounding the central tube of the drilling riser to a receptacle in one of the one or more control pods.

16. In a subsea blowout preventer stack system connected to the surface with a drilling riser, and with one or more control pods for control of the subsea blowout preventer stack, a method of providing a control umbilical of near neutral buoyancy in the ocean water to provide control signals to the one or more control pods comprising providing a core of conductors such as wires and optical fibers, providing a flexible outer core comprising a mixture of resilient material and buoyant materials, providing a connector on the lower end of the umbilical, and lowering the connector and the control umbilical down passages on the drilling riser.

17. The method of claim 16 further providing the connector on the lower end of the umbilical provides mechanical interface to actuate a device within a control pod.

18. The method of claim 17 further providing the device within a control pod is a valve.

19. The method of claim 17 further providing the connector has wheels to engage a receptacle to orient the connector and/or to fully axially engage the connector with the receptacle.

* * * * *